US007192308B2

(12) United States Patent
Rodrigues et al.

(10) Patent No.: US 7,192,308 B2
(45) **Date of Patent: *Mar. 20, 2007**

(54) COAXIAL CONNECTOR HAVING DETACHABLE LOCKING SLEEVE

(75) Inventors: Julio F. Rodrigues, Collerville, TN (US); Salvatore J. Abbruzzese, Piscataway, NJ (US); Brian S. Welborn, The Woodlands, TX (US)

(73) Assignee: Thomas & Betts International, Inc., Sparks, NV (US)

( * ) Notice: Subject to any disclaimer, the term of this patent is extended or adjusted under 35 U.S.C. 154(b) by 12 days.

This patent is subject to a terminal disclaimer.

(21) Appl. No.: 10/848,497

(22) Filed: May 18, 2004

(65) Prior Publication Data

US 2005/0003705 A1 Jan. 6, 2005

Related U.S. Application Data

(63) Continuation of application No. 10/359,498, filed on Feb. 6, 2003, now Pat. No. 6,767,247, which is a continuation of application No. 09/852,343, filed on May 9, 2001, now Pat. No. 6,530,807.

(60) Provisional application No. 60/202,972, filed on May 10, 2000, provisional application No. 60/215,299, filed on Jun. 30, 2000.

(51) Int. Cl.
*H01R 9/05* (2006.01)

(52) U.S. Cl. ..... 439/578; 439/584; 439/585

(58) Field of Classification Search ..... 439/578, 439/584, 585, 583

See application file for complete search history.

(56) References Cited

U.S. PATENT DOCUMENTS

| | | | |
|---|---|---|---|
| 1,667,485 | A | 4/1928 | MacDonald |
| 2,258,737 | A | 10/1941 | Browne |
| 2,549,647 | A | 4/1951 | Turenne |
| 3,076,168 | A | 1/1963 | Keen |
| 3,184,706 | A | 5/1965 | Atkins |
| 3,275,913 | A | 9/1966 | Blanchard et al. |
| 3,292,136 | A | 12/1966 | Somerset |
| 3,350,677 | A | 10/1967 | Daum |

(Continued)

FOREIGN PATENT DOCUMENTS

DE 102289 1/1958

(Continued)

OTHER PUBLICATIONS

PPC 1996/97 Connector and Trap Product Catalog p. 34.

(Continued)

*Primary Examiner*—Tho D. Ta
(74) *Attorney, Agent, or Firm*—Hoffmann & Baron, LLP

(57) ABSTRACT

A connector is provided for terminating coaxial cable. The connector includes a connector body having a cable receiving end and an opposed connection end. A locking sleeve is provided in detachable, re-attachable snap engagement with the insertion end of the connector body for securing the cable in the connector body. The cable may be terminated to the connector by inserting the cable into the locking sleeve or the locking sleeve may be detachably removed from the connector body and the cable inserted directly into the cable body with the locking sleeve detached subsequently.

18 Claims, 2 Drawing Sheets

U.S. PATENT DOCUMENTS

| | | | |
|---|---|---|---|
| 3,355,698 | A | 11/1967 | Keller |
| 3,373,243 | A | 3/1968 | Janowiak et al. |
| 3,406,373 | A | 10/1968 | Forney, Jr. |
| 3,448,430 | A | 6/1969 | Kelly |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,564,487 | A | 2/1971 | Upstone et al. |
| 3,629,792 | A | 12/1971 | Dorrell |
| 3,633,150 | A | 1/1972 | Swartz |
| 3,668,612 | A | 6/1972 | Nepovim |
| 3,671,922 | A | 6/1972 | Zerlin et al. |
| 3,694,792 | A | 9/1972 | Wallo |
| 3,694,793 | A | 9/1972 | Concelman |
| 3,710,005 | A | 1/1973 | French |
| 3,778,535 | A | 12/1973 | Forney, Jr. |
| 3,781,762 | A | 12/1973 | Quackenbush |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,963,320 | A | 6/1976 | Spinner |
| 3,976,352 | A | 8/1976 | Spinner |
| 3,980,805 | A | 9/1976 | Spinner |
| 3,985,418 | A | 10/1976 | Lipari |
| 4,046,451 | A | 9/1977 | Juds et al. |
| 4,053,200 | A | 10/1977 | Pugner |
| 4,059,330 | A | 11/1977 | Shirey |
| 4,093,335 | A | 6/1978 | Schwartz et al. |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,156,554 | A | 5/1979 | Aujla |
| 4,165,554 | A | 8/1979 | Faget |
| 4,168,921 | A | 9/1979 | Blanchard |
| 4,225,162 | A | 9/1980 | Dola |
| 4,227,765 | A | 10/1980 | Neumann et al. |
| 4,250,348 | A | 2/1981 | Kitagawa |
| 4,280,749 | A | 7/1981 | Hemmer |
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward et al. |
| 4,408,821 | A | 10/1983 | Forney, Jr. |
| 4,408,822 | A | 10/1983 | Nikitas |
| 4,421,377 | A | 12/1983 | Spinner |
| 4,444,453 | A | 4/1984 | Kirby et al. |
| 4,456,323 | A | 6/1984 | Pitcher et al. |
| 4,484,792 | A | 11/1984 | Tengler et al. |
| 4,515,427 | A | 5/1985 | Smit |
| 4,533,191 | A | 8/1985 | Blackwood |
| 4,540,231 | A | 9/1985 | Forney, Jr. |
| 4,545,637 | A | 10/1985 | Bosshard et al. |
| 4,575,274 | A | 3/1986 | Hayward |
| 4,583,811 | A | 4/1986 | McMills |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,614,390 | A | 9/1986 | Baker |
| 4,632,487 | A | 12/1986 | Wargula |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,666,229 | A | 5/1987 | Grand |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,717,355 | A | 1/1988 | Mattis |
| 4,738,009 | A | 4/1988 | Down et al. |
| 4,746,305 | A | 5/1988 | Nomura |
| 4,747,786 | A | 5/1988 | Hayashi et al. |
| 4,755,152 | A | 7/1988 | Elliot et al. |
| 4,761,146 | A | 8/1988 | Sohoel |
| 4,772,222 | A | 9/1988 | Laudig et al. |
| 4,789,355 | A | 12/1988 | Lee |
| 4,806,116 | A | 2/1989 | Ackerman |
| 4,813,886 | A | 3/1989 | Roos et al. |
| 4,834,675 | A | 5/1989 | Samchisen |
| 4,834,676 | A | 5/1989 | Tackett |
| 4,854,893 | A | 8/1989 | Morris |
| 4,857,014 | A | 8/1989 | Alf et al. |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 5,002,503 | A | 3/1991 | Campbell et al. |
| 5,007,861 | A | 4/1991 | Stirling |
| 5,021,010 | A | 6/1991 | Wright |
| 5,024,606 | A | 6/1991 | Ming-Hwa |
| 5,037,328 | A | 8/1991 | Karlovich |
| 5,062,804 | A | 11/1991 | Jamet et al. |
| 5,066,248 | A | 11/1991 | Gaver, Jr. et al. |
| 5,073,129 | A | 12/1991 | Szegda |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,141,451 | A | 8/1992 | Down |
| 5,161,993 | A | 11/1992 | Leibfried, Jr. |
| 5,181,161 | A | 1/1993 | Hirose et al. |
| 5,195,906 | A | 3/1993 | Szegda |
| 5,205,761 | A | 4/1993 | Nilsson |
| 5,207,602 | A | 5/1993 | McMills et al. |
| 5,217,391 | A | 6/1993 | Fisher, Jr. |
| 5,217,393 | A | 6/1993 | Del Negro et al. |
| 5,269,701 | A | 12/1993 | Liebfried, Jr. |
| 5,283,853 | A | 2/1994 | Szegda |
| 5,284,449 | A | 2/1994 | Vaccaro |
| 5,295,864 | A | 3/1994 | Birch et al. |
| 5,316,494 | A | 5/1994 | Flanagan et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,371,819 | A | 12/1994 | Szegda |

| | | | |
|---|---|---|---|
| 5,371,821 | A | 12/1994 | Szegda |
| 5,371,827 | A | 12/1994 | Szegda |
| 5,393,244 | A | 2/1995 | Szegda |
| 5,431,583 | A | 7/1995 | Szegda |
| 5,435,745 | A | 7/1995 | Booth |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,494,454 | A | 2/1996 | Johnsen |
| 5,501,616 | A | 3/1996 | Holliday |
| 5,525,076 | A | 6/1996 | Down |
| 5,542,861 | A | 8/1996 | Anhalt et al. |
| 5,548,088 | A | 8/1996 | Gray et al. |
| 5,571,028 | A | 11/1996 | Szegda |
| 5,586,910 | A | 12/1996 | Del Negro et al. |
| 5,598,132 | A | 1/1997 | Stabile |
| 5,607,325 | A | 3/1997 | Toma |
| 5,620,339 | A | 4/1997 | Gray et al. |
| 5,632,651 | A | 5/1997 | Szenga |
| 5,651,699 | A | 7/1997 | Holliday |
| 5,667,405 | A | 9/1997 | Holliday |
| 5,863,220 | A | 1/1999 | Holiday |
| 5,879,191 | A | 3/1999 | Burris |
| 5,967,852 | A | 10/1999 | Follingstad et al. |
| 5,975,951 | A | 11/1999 | Burris et al. |
| 5,997,350 | A | 12/1999 | Burris et al. |
| 6,032,358 | A | 3/2000 | Wild |
| 6,089,912 | A | 7/2000 | Tallis |
| 6,089,913 | A | 7/2000 | Holliday |
| 6,146,197 | A | 11/2000 | Holliday et al. |
| D436,076 | S | 1/2001 | Montena |
| D437,826 | S | 2/2001 | Montena |
| D440,539 | S | 4/2001 | Montena |
| D440,939 | S | 4/2001 | Montena |
| 6,210,222 | B1 | 4/2001 | Langham et al. |
| 6,241,553 | B1 | 6/2001 | Hsia |
| 6,267,621 | B1 | 7/2001 | Pitschi et al. |
| D458,904 | S | 6/2002 | Montena |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,425,782 | B1 | 7/2002 | Holand |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| D468,696 | S | 1/2003 | Montena |
| 6,530,807 | B2 | 3/2003 | Rodrigues et al. |
| 6,558,194 | B2 | 5/2003 | Montena |
| 6,817,896 | B2 | 11/2004 | Deventhal |
| 6,848,940 | B2 | 2/2005 | Montena |
| 2003/0162439 | A1 | 8/2003 | Rodrigues et al. |
| 2005/0003705 | A1 | 1/2005 | Rodrigues et al. |

FOREIGN PATENT DOCUMENTS

| | | |
|---|---|---|
| DE | 1117687 | 11/1961 |
| DE | 1191880 | 4/1965 |
| DE | 47931 | 5/1966 |
| DE | 1515398 | 4/1970 |
| DE | 2225764 | 5/1972 |
| DE | 2221936 | 11/1973 |
| DE | 2261973 | 6/1974 |
| DE | 22225764 | 6/1974 |
| DE | 3211008 | 10/1983 |
| EP | 0072104 | 2/1983 |
| EP | 0116157 | 8/1984 |
| EP | 0167738 | 1/1986 |
| EP | 0265276 | 4/1988 |
| FR | 2232846 | 6/1974 |
| FR | 2234680 | 6/1974 |
| FR | 2462798 | 8/1979 |
| GB | 589697 | 6/1947 |
| GB | 1087228 | 10/1967 |
| GB | 1270846 | 10/1967 |
| GB | 2019665 | 10/1979 |
| GB | 2079549 | 1/1983 |
| JP | 11-8795 | 11/1999 |
| JP | U2000-5870 | 8/2000 |
| WO | WO93/24973 | 12/1993 |
| WO | WO96/08854 | 3/1996 |
| WO | WO 99/07035 | 2/1999 |

OTHER PUBLICATIONS

PPC Compression Connector Series Product Data Sheet, dated Feb. 20, 1996, also published in the Record on Appeal of LRC Electronics, Inc. v. John Mezzalingua Associates, Inc., U.S. Court of Appeals for the Federal Circuit, Appeal No. 98-1545, at A-2604 and 2604a.

PPC CMP Radial Compression Connector (Unlocked) Data Sheet 1995, marked as a deposition exhibiton May 3, 1996 and Plaintiff's Trial Exhibit 115 on Jan. 27, 1998, also published in the Record on Appeal of LRC Electronics, Inc. v. John Mezzalingua Associtaes, Inc., U.S. Court of Appeals for the Federal Circuit, Appeal No. 98-1545, at A-2687.

Thomas & Betts Snap-N-Seal "F" Series Male Environmentally Sealed Connectors Data Sheet 1998, retrieved from Internet archive at www.waybackmachine.org on Jun. 14, 2005 from archived Thomas & Betts Corp. website (www,tnb.com) dated Dec. 3, 1998 (http://web.archive.org/web/20000831012924/www.tnb.com/download/lrc/snap_seal.pdf).

Sell Sheet from Stirling; www.StirlingUSA.com; Reader Service No. 109; regarding SPL-6-RTQ 3-In-One RTQ Connectors.

Sell Sheet from PCT International; Reader Service No. 133; regarding DRS Compression Connectors—description/features and benefits.

FIG. 1
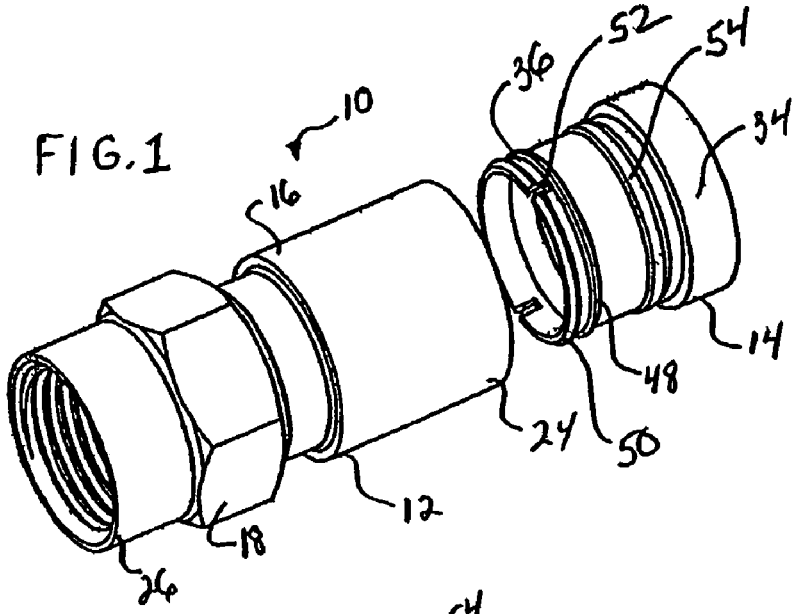
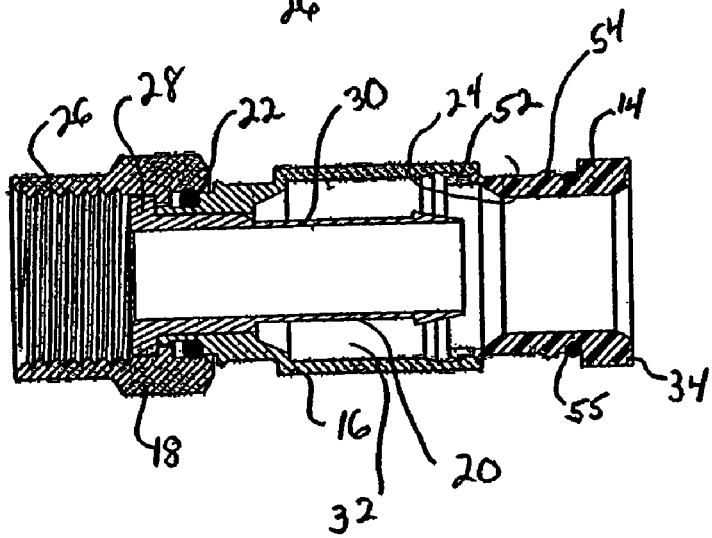
FIG. 2
FIG. 3
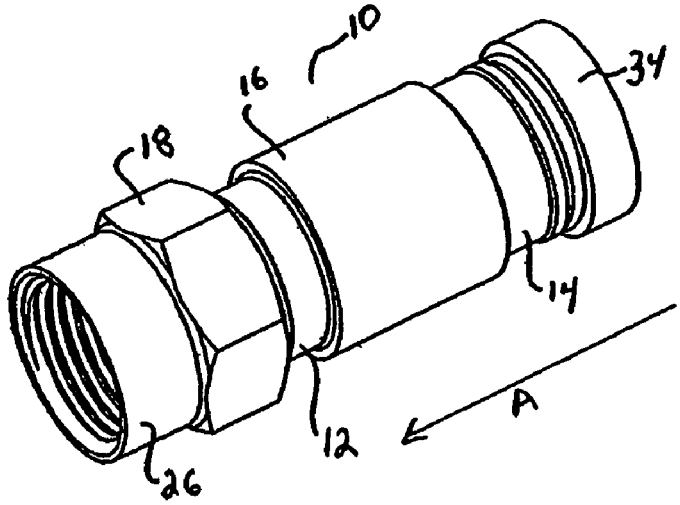

COAXIAL CONNECTOR HAVING DETACHABLE LOCKING SLEEVE

This application is a continuation of and claims priority to U.S. application Ser. No. 10/359,498 filed Feb. 6, 2003 now U.S. Pat. No. 6,767,247, which is a continuation of U.S. application Ser. No. 09/852,343 filed May 9, 2001, now U.S. Pat. No. 6,530,807, which claims priority to U.S. Provisional Application No. 60/202,972 filed May 10, 2000 and No. 60/215,299 filed Jun. 30, 2000.

FIELD OF THE INVENTION

The present invention relates generally to connectors for terminating coaxial cable. More particularly, the present invention relates to a coaxial cable connector having a locking sleeve which is detachably coupled to the connector body.

BACKGROUND OF THE INVENTION

It has long been known to use connectors to terminate coaxial cable so as to connect a cable to various electronic devices such as televisions, radios and the like.

Conventional coaxial cables typically include a center conductor surrounded by an insulator. A braided or foil conductive shield is disposed over the insulator. An outer insulative jacket surrounds the shield. In order to prepare the coaxial cable for termination, the outer jacket is stripped back exposing an extent of the conductive shield which is folded back over the jacket. A portion of the insulator extends outwardly from the jacket and an extent of the center conductor extends outwardly from insulator. Such a prepared cable may be terminated in a conventional coaxial connector.

Coaxial connectors of this type include a connector body having an inner cylindrical post which is inserted between the insulator and the conductive shield. A locking sleeve is provided to secure the cable within the body of the coaxial connector. The locking sleeve, which is typically formed of a resilient plastic, is securable to the connector body to secure the coaxial connector thereto. As coaxial connectors of this type require a two-piece construction, including the body and the sleeve, often during shipping, handling and installation, the parts may become lost or misplaced.

U.S. Pat. No. 4,834,675 addresses this problem by providing a coaxial connector where the locking sleeve is frangibly tethered to the connector body. Prior to installation, the locking sleeve is frangibly removed from the connector body whereupon the locking sleeve is inserted onto the cable and the cable is inserted into the connector body for securement thereto. While the connector of the '675 patent reduces the risk of mishandling or loss of the connector components during shipment, upon installation the locking sleeve must still be removed from the connector body and attached to the cable separately. Thus, there is still a risk of mishandling or loss of components during installation.

This problem is further addressed in U.S. Pat. No. 5,470,257 where a coaxial connector is provided with a locking sleeve being inseparably coupled to a connector body. Cable termination using the connector of the '257 patent requires that the prepared coaxial cable be inserted axially through both the locking sleeve and connector body. Thereafter, the locking sleeve can be axially advanced so as to secure the cable in the connector body.

While in many installations, this form of cable termination is acceptable, it has been found that insertion of the prepared cable through both the locking sleeve and the connector body may be difficult in certain situations. As the cable installer typically works outdoors in an elevated or underground environment, it may become difficult to "blind" insert the prepared cable through the locking sleeve and into proper position around the cylindrical post of the connector body. In these situations, it would be desirable to permit the removal of the locking sleeve from the connector body so that the cable could be directly inserted into the connector body.

It is, therefore, desirable to provide a coaxial connector which supports the locking sleeve on the connector body, but which when circumstances require, permits the removal of the locking sleeve therefrom to permit ease of cable termination.

SUMMARY OF THE INVENTION

It is an object of the present invention to provide a coaxial cable connector for terminating a coaxial cable.

It is a further object of the present invention to provide a coaxial cable connector having a connector body and a locking sleeve where the locking sleeve secures the cable within the connector body.

It is a further object of the present invention to provide a coaxial cable connector having a connector body and a locking sleeve in detachable, re-attachable snap engagement with the connector body to permit direct insertion of the cable through the locking sleeve and the connector body. Alternatively, where circumstances require, the present invention permits removal of the locking sleeve from the connector body for subsequent separate reattachment.

It is another object of the present invention to provide a method of terminating a coaxial cable.

In the efficient attainment of these and other objects, the present invention provides a coaxial cable connector. The connector of the present invention includes a connector body having a cable receiving end and an opposed connection end. A locking sleeve is provided in detachable, re-attachable snap engagement with the insertion end of the connector body for securing the cable in the connector body. The locking sleeve is movable from a first position loosely retaining the cable in the connector body to a second position locking said cable to the connector body.

In a preferred embodiment of the present invention, the locking sleeve is in resilient detachable, re-attachable snap engagement with the connector body. The resilient detachable, re-attachable engagement is provided by cooperative detent structure between a portion of the sleeve insertable into the connector body and a portion of the connector body which receives the sleeve. This detent structure includes a rib and groove arrangement which provides for the detachable coupling of the sleeve to the connector body.

In a further preferred embodiment, the detachable engagement of the sleeve to the connector body may include one or more slots extending through the end of the sleeve which is inserted into the connector body. The slots facilitate resilient detachment and reattachment of the sleeve from the connector body.

In its method aspect, the present invention provides for the termination of a coaxial connector with a connector. The method provides for the detaching of a locking sleeve from a connector body. The sleeve is then positioned over the cable. The cable is then inserted into the end of the connector. The sleeve is then reattached to the end of the connector body to secure the cable thereto.

BRIEF DESCRIPTION OF THE DRAWINGS

FIG. 1 is an exploded perspective showing of the coaxial connector of the present invention including a connector body and a detachably coupled locking sleeve.

FIG. 2 is a longitudinal sectional showing of the connector of FIG. 1.

FIG. 3 shows the connector of FIG. 1 with the sleeve detachably coupled to the connector body.

DETAILED DESCRIPTION OF THE PREFERRED EMBODIMENTS

Figure 4:
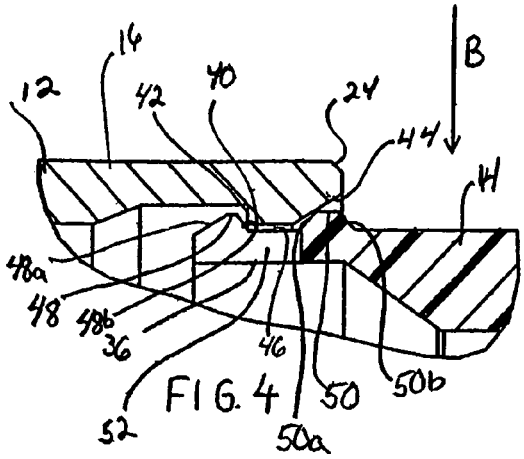
FIGS. 4–6 are enlarged sectional showings of the engagement between the connector body and the locking sleeve.

The present invention is directed to connectors for terminating coaxial cable. Coaxial connectors of this type are shown and described in U.S. Pat. No. 4,834,675 issued May 30, 1989, which is incorporated by reference herein for all purposes.

Referring to FIGS. 1–3, the coaxial cable connector 10 of the present invention is shown.

Connector 10 includes two major components, a connector body 12 and a locking sleeve 14 attachably coupled to body 12. Body 12 is an elongate generally cylindrical conductive member typically formed of metal, preferably brass. Body 12 includes an annular collar 16 for accommodating a coaxial cable, an annular nut 18 rotatably coupled to collar 16 for providing mechanical attachment of the connector to an external device. Interposed between collar 16 and nut 18 is an annular post 20. A resilient sealing O-ring 22 may be positioned between collar 16 and nut 18 at the rotatable juncture thereof to provide a seal thereat. Collar 16 includes a cable receiving end 24 for insertably receiving an inserted coaxial cable. Nut 18 includes an internally threaded end extent 26 permitting screw threaded attachment of body 12 to the external device. Cable receiving end 24 and internally threaded end extension 26 define the opposed ends of connector body 12. Annular post 20 includes a base portion 28 which provides for securement of post 20 between nut 18 and collar 16 and an annular tubular extension 30 extending into collar 18. As will be described in further detail hereinbelow and as is conventionally known, the extension 30 of post 20 and the collar 16 define an annular chamber 32 for accommodating the jacket and shield of the inserted coaxial cable.

Locking sleeve 14 is a generally cylindrical member formed of resilient material preferably a synthetic plastic such as an acetate resin. Locking sleeve 14 includes a flared rearward end 34 through which a cable may be inserted. Opposite rearward end 34 is a forward end 36 which is insertable into receiving end 24 of collar 16. As will be described in further detail hereinbelow, the forward end 36 of locking sleeve 14 and the receiving end 24 of collar 16 include cooperative detent structure which allows for the detachable, re-attachable connection of locking sleeve 14 to body 12. Furthermore, connector 10 is designed such that locking sleeve 14 is axially moveable along arrow A of FIG. 3, towards nut 18 from a first position shown in FIG. 4, which loosely retains the cable within connector body 12 through an intermediate position shown in FIG. 5, to a more forward second position shown in FIG. 6, which secures the cable within connector body 12.

The connector 10 of the present invention is constructed so as to be supplied in the assembled condition shown in FIG. 3. In such assembled condition, and as will be described in further detail hereinbelow, a coaxial cable may be inserted through the rearward end 34 of locking sleeve 14 and through connector body 12. The locking sleeve may be moved from the first position loosely retaining the cable to the second position which is axially forward thereby locking the cable to the connector body. It is, however, contemplated that the locking sleeve 14 may be detached from connector body 12 and in a manner which will be described in further detail hereinbelow, so as to allow the coaxial cable to be inserted directly into receiving end 24 of connector body 12. Thereafter, the locking sleeve 14 which has been placed around the cable may be reattached to receiving end 24 of body 12 where it can be moved from the first position to the second position locking the cable to the connector body.

The cooperating detent structure mentioned above, is employed to provide such detachment and reattachment of locking sleeve 14 to connector body 12. With additional reference to FIGS. 4–6, the cooperating detent structure is shown.

Receiving end 24 of collar 16 of connector body 12 includes a radially inwardly directed annular rib 40 extending adjacent the distal end thereof. Rib 40 is defined by a forwardly facing perpendicular wall 42 and a rearwardly facing chamfered wall 44.

The cooperating detent structure of the present invention further includes the forward end 36 of locking sleeve 14 formed to have a radially outwardly opening annular groove 46 adjacent a distal end thereof. Groove 46 is constructed so as to receive rib 40 of collar 16. Groove 46 is defined by a pair of spaced apart radially outwardly directed rings 48 and 50. Ring 48 which is axially forward of ring 50 is defined by opposed oppositely chamfered walls 48*a* and 48*b*. Similarly, ring 50 which is axially rearward, is defined by a pair of opposed oppositely chamfered walls 50*a* and 50*b*. As may be appreciated, the forward end 36 of locking sleeve 14 may be inserted into the receiving end 24 of collar 16. Upon insertion, the forward chamfered wall 48*a* of ring 48 bears against chamfered wall 44 of collar 16. Due to the resilient nature of material forming locking sleeve 14, the ring 48 will ride over rib 40 and the rib 40 will become lockingly resident within groove 46. This defines the first position of locking sleeve 14.

While the locking sleeve is accommodated in collar 16 by engagement between the rib 40 in groove 46, locking sleeve 14 may be detachably removed from locking sleeve 14. Such detachable removal is facilitated by the resiliency of the plastic material forming locking sleeve 14 and relative thickness of the sleeve wall thereat. Furthermore, ring 48 includes rearward chamfered wall 48*b* which permits the wall to ride against perpendicular wall 42 of sleeve 16 upon rearward movement of locking sleeve 14. Such construction of the forward end 36 of sleeve 14 together with the formation of chamfered wall 48*b* and the resiliency and the thinness of the plastic material, allows the locking sleeve to be detachably coupled from the collar 16.

Figure 5:
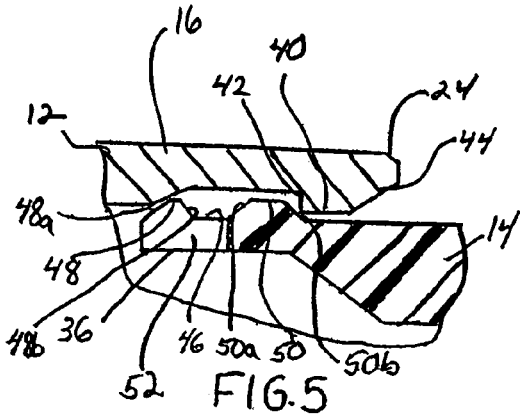

Furthermore, as particularly shown in FIGS. 1 and 4–6, the forward end 36 of the locking sleeve may include one or more axially extending slots 52 therethrough. The slots 52 are optionally included to enhance the resilient deflectability of the forward end 36 of locking sleeve 14. Where used, slots may be provided in any number desired to provide the degree of flexibility required to removably detach locking sleeve 14 from collar 16 without making the locking sleeve so deflectable that it inadvertently detaches from collar 16 during normal handing and shipment. Furthermore, the length of slots 52 may be selected to enhance the flexibility of forward end 36. As shown in FIGS. 4 and 5, a longer slot 52 may be provided as compared with a shorter slot shown in FIG. 6.

It is further contemplated that while the locking sleeve is designed to be detachably coupled from collar 16 by moving sleeve 14 in a rearward direction with respect to collar 16, a slight transverse force in a direction of arrow B may be of assistance in detaching locking sleeve 14 from collar 16.

Figure 6:
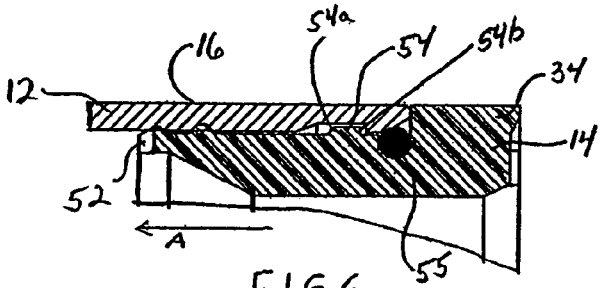
Figure 7:
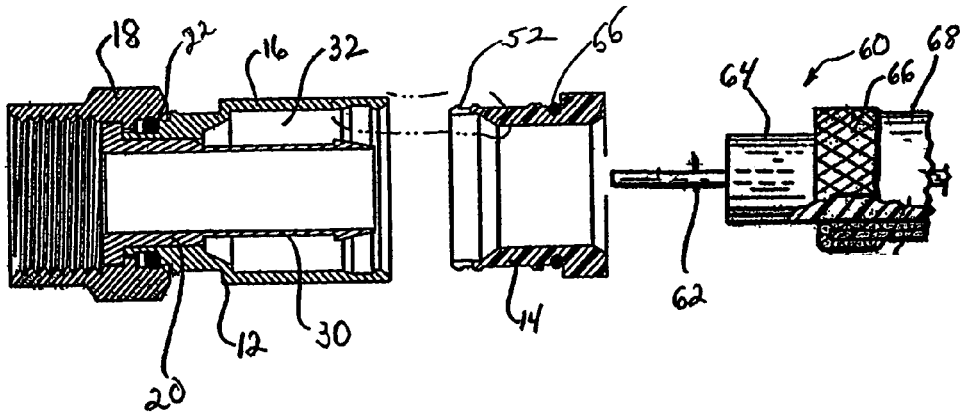
FIG. 7 is an exploded sectional showing of the termination of a prepared coaxial cable with the connector of the present invention.

As more fully shown in FIGS. 6 and 7, the cooperative detent structure further includes a radially outwardly extending end ring 54 adjacent rearward end 34 of sleeve 14. Upon continued coaxial movement along arrow A, ring 54 engages and rides over rib 40 of collar 16 to define the second position which locks cable to connector body 12.

Having described the components of connector 10 in detail, the use of connector 10 in terminating a coaxial cable may now be described with respect to FIGS. 4–7.

Coaxial cable 60 includes an elongate inner conductor 62 formed of copper or similar conductive material. Extending around inner conductor 62 is a conductor insulator 64 formed of a suitably insulative plastic. A metallic shield 66 is positioned in surrounding relationship around insulator 64. As shown in FIG. 5, shield 66 is a metallic braid, however, other conductive materials such as metallic foil may also be employed. Covering shield 66 is an outer insulative jacket 68.

Cable 60 is prepared in conventional fashion for termination, by stripping back jacket 68 exposing an extent of shield 66. A portion of insulator 64 extends therefrom with an extent of conductor 62 extending from insulator 64. The preparation process includes folding back an end extent of shield 66 about jacket 68.

As shown in exploded view in FIG. 7, cable 60 may be inserted into connector 10 with the locking sleeve 14 coupled to collar 16 of body 12 as shown in FIGS. 2 and 3. In this technique, the prepared cable 60 is inserted through rearward end 34 of sleeve 14 and into the receiving end 24 of collar 16. Extension 30 of post 20 of body 12 is inserted between the insulator 64 in the metallic shield 66 such that the shield and the jacket 68 reside within the annular region 32 defined between post 20 and collar 16. In this position, the locking sleeve is coupled to collar 16 in the first position shown in FIG. 4. In such first position, sufficient clearance is provided between sleeve 14 and collar 16 so that extension 30 may easily be interposed between insulator 64 and shield 66.

Once the cable 60 is properly inserted, the locking sleeve 14 may be moved from the first position shown in FIG. 4, to an intermediate position shown in FIG. 5, where the locking sleeve is moved axially forward so that the rearward ring 50 rides over rib 40 so as to reside forward of perpendicular wall 42. Such movement is facilitated by the chamfered wall 44 of receiving end 24 of collar 16 and the forward chamfered wall 50*a* of ring 50. In this second position, the jacket 68 and shield 66 of cable 60 begins to become compressively clamped within annular region 32 between post 20 and collar 16. The sleeve 14 is further axially advanced along arrow A from the intermediate position shown in FIG. 5, to a second position shown in FIG. 6. Such second position is achieved as the end ring 54 resiliently rides over rib 40 of collar 16. In that regard, end ring 54 has a forwardly chamfered front wall 54*a* for engagement with chamfered wall 44 of collar 16 to facilitate such resilient movement. Further, the rear wall 54*b* of ring 54 is perpendicular so as to engage perpendicular wall 42 of rib 40 to maintain sleeve 14 in the second position with respect to collar 16. A suitable tool may be used to effect movement of locking sleeve 14 from its first position to its second position securing cable 60 to connector body 12.

It is contemplated that the engagement between insulative jacket 68 and the connector body 12 establishes a sealed engagement thereat. In order to further facilitate the seal, locking sleeve 14 may optionally support a sealing O-ring 55 which provides a seal with the chamfered wall 44 of collar 16 in the second position.

As may be appreciated, proper insertion of cable 60 into connector body 12 requires that the cable be inserted in such a manner that the extension 30 of post 20 becomes resident between insulator 64 and shield 66. In certain installation settings, the installer may not have clear and convenient access when terminating cable 60. Moreover, insertion may be rendered difficult by poor cable preparation, which may result in a frayed end. Therefore, it may be difficult for the installer to blindly insert the cable 60 through the locking sleeve 14 and into connector body 12. In such situations, the present invention contemplates the ability to detachably remove locking sleeve 14 from connector body 12 so that the cable may be directly inserted to receiving end 24 of collar 16. In these situations, locking sleeve 14 is detachably removed from collar 16 in a manner facilitated as above described. The locking sleeve is then slipped over cable 60 and moved to a convenient position along the cable length. The end of cable 60 may then be inserted directly into the rearward end 34 of collar 16 to easily assure that extension 30 of post 20 is inserted between insulator 64 and shield 66. Thereafter, the locking sleeve 14 may be brought up along the cable and the forward end 36 of locking sleeve 14 may be inserted into the rearward end 34 of collar 16. The chamfered wall 48*a* of ring 48 together with the chamfered wall 44 of collar 16 and optionally the slots 52, facilitates insertion of the locking sleeve into collar 16 so that rib becomes resident within groove 46 as shown in FIG. 4 defining the first position. Thereafter, as described above, the locking sleeve may be moved from the first position shown in FIG. 4 to a second position shown in FIG. 6 where the end ring 54 becomes resident forward of perpendicular wall 42 thereby locking cable 60 in connector body 12.

Various changes to the foregoing described and shown structures will now be evident to those skilled in the art. Accordingly, the particularly disclosed scope of the invention is set forth in the following claims.

What is claimed:

1. A connector for terminating an end of a coaxial cable comprising:

a connector body having a cable receiving end for accommodating said end of said cable; and a locking sleeve coupled to said cable receiving end of said body and being detachable and reattachable thereto to define an attached position and a detached position, said locking sleeve adapted to receive said cable end in either of said attached or detached positions and being movable with respect to said connector body for locking said cable to said connector body;

wherein said connector body and said locking sleeve include cooperative detent structure for permitting said detachment and reattachment of said connector body and said locking sleeve, said cooperative detent structure including:

said connector body having a rib; and said locking sleeve including an annular groove defined between a pair of spaced apart sleeve rings;

said rib being resident within said groove in a first position; and wherein said sleeve rings include a forward sleeve ring and a rearward sleeve ring, said forward sleeve ring including a rearwardly directed chamfered wall to permit resilient detachment of said locking sleeve from said body.

2. A connector of claim 1 wherein said locking sleeve includes at least one slot formed at least partially through a forward end thereof, said slot facilitating said resilient detachment of said sleeve from said body.

3. A connector of claim 1 wherein said forward end of said sleeve includes a plurality of circumferentially spaced slots formed at least partially through a forward end thereof, said slots facilitating said resilient detachment of said sleeve from said body.

4. A connector of claim 1 wherein said locking sleeve is made of a plastic material, said detachable and reattachable attachment of said locking sleeve to said cable receiving end of said body being facilitated by resiliency of said plastic material.

5. A connector of claim 1 wherein said locking sleeve has a forward end attachable to said connector body and said annular groove is provided at the locking sleeve forward end.

6. A connector of claim 1 wherein said locking sleeve is movable with respect to said body from a first position retaining said cable end to a second position locking said cable to said cable body.

7. A connector of claim 5 wherein said locking sleeve is coupled to said body in said second position.

8. A connector of claim 1 wherein said rearward sleeve ring includes a forwardly directed chamfered wall to facilitate axial movement of said locking sleeve.

9. A connector of claim 8 wherein said locking sleeve includes a radially outwardly directed end ring adjacent said cable receiving end thereof.

10. A connector of claim 9 wherein said end ring is engageable with said body rib of said connector body upon said axial movement to define said second position.

11. A coaxial cable connector comprising:

a connector body having a receiving end; and a locking sleeve formed of resilient plastic and attachably coupled to said connector body receiving end, said locking sleeve having a rearward end through which an end of a prepared coaxial cable may be inserted and a forward end defining a forward peripheral edge opposite said rearward end, said forward end being insertable into said receiving end of said connector body and having a radially outwardly directed ring formed at said forward end, said ring cooperating with structure at said connector body receiving end for holding said locking sleeve in said connector body in a first position;

wherein said locking sleeve is detachable and reattachable to said cable receiving end of said body, said detachable and reattachable attachment being facilitated by said resiliency of said plastic material; and wherein said locking sleeve is movable with respect to said connector body to a second position for locking said cable within said connector.

12. A coaxial cable connector as defined in claim 11 wherein said radially outwardly directed ring forms part of a cooperating detent structure for permitting said locking sleeve to be detached and reattached to said connector body.

13. A coaxial cable connector comprising:

a connector body having a receiving end and an annular rib; and a locking sleeve formed of resilient plastic and attachably coupled to said connetor body receiving end, said locking sleeve having a rearward end through which an end of a prepared coaxial cable may be inserted and a forward end defining a forward peripheral edge opposite said rearward end, said forward end being insertable into said receiving end of said connector body and having an annular groove defined between first and second spaced apart rings formed at said forward end, said rings cooperating with said annualar rib of said connector body receiving end for holding said locking sleeve in said connector body in a first position;

wherein said locking sleeve is detachable and reattachable to said cable receiving end of said body, said detachable and reattachable attachment being facilitated by said resiliency of said plastic material; and wherein said ring formed on said forward peripheral edge of said locking sleeve includes a rearwardly directed chamfered wall to permit detachment of said locking sleeve from said body.

14. A coaxial cable connector as defined in claim 13, wherein said second sleeve ring includes a forwardly directed chamfered wall to facilitate axial movement of said locking sleeve from said first position to said second position.

15. A coaxial cable connector for terminating an end of a coaxial cable comprising:

a connector body having a cable receiving end; and a locking sleeve removably secured to said cable receiving end of said connector body and movable from a first position retaining said cable end to a second position locking said cable to said connector body;

said locking sleeve being optionally attached to or detached from said body prior to inserting said coaxial cable into said cable receiving end for subsequent cable termination within said body;

wherein one of said connector body or said locking sleeve having a rib and the other of said connector body or locking sleeve including a mating groove, said rib being resident within said groove in said first position for permitting said locking sleeve to be removably secured to said connector body.

16. A connector of claim 15 wherein said locking sleeve includes at least one slot formed at least partially through a forward end of said locking sleeve, said slot facilitating said removability of said locking sleeve from said connector body.

17. A connector of claim 15 wherein said locking sleeve is made of a plastic material, the resiliency of said plastic material facilitating the removability of said locking sleeve from said connector body.

18. A cable connector comprising:

a connector body having a retention rib with a first wall and a chamfered second wall axially opposite the first wall;

a locking sleeve having an attachment end that is secured to the connector body and a cable receiving end opposite the attachment end, the locking sleeve including a shipping position and a locked position;

a first annular flange disposed on the attachment end; and a chamfered second annular flange disposed on the attachment end and axially space.d from the first annular flange such that a groove is formed between the first annular flange and the second annular flange for receiving the retention rib therein and that the chamfer of the second annular flange is complimentary to the chamfer of the second wall for transitioning the locking sleeve from the shipping position to the locked position.

* * * * *

UNITED STATES PATENT AND TRADEMARK OFFICE

CERTIFICATE OF CORRECTION

PATENT NO. : 7,192,308 B2
APPLICATION NO. : 10/848497
DATED : March 20, 2007
INVENTOR(S) : Rodrigues et al.

It is certified that error appears in the above-identified patent and that said Letters Patent is hereby corrected as shown below:

Column 8, line 57, claim 18, now reads "...axially space.d from the..." It should read as --...axially spaced from the...--.

Signed and Sealed this

Twenty-ninth Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,192,308 B2
APPLICATION NO. : 10/848497
DATED : March 20, 2007
INVENTOR(S) : Rodrigues et al.

It is certified that error appears in the above-identified patent and that said Letters Patent is hereby corrected as shown below:

Column 8, line 61, claim 18, now reads "...is complimentary to...". It should read as --...is complementary to...--.

Signed and Sealed this

Sixth Day of January, 2009

JON W. DUDAS
*Director of the United States Patent and Trademark Office*

US007192308C1

(12) EX PARTE REEXAMINATION CERTIFICATE (8954th)

United States Patent
Rodrigues et al.

(10) Number: US 7,192,308 C1
(45) **Certificate Issued: *Apr. 10, 2012**

(54) COAXIAL CONNECTOR HAVING DETACHABLE LOCKING SLEEVE

(75) Inventors: Julio F. Rodrigues, Collerville, TN (US); Salvatore J. Abbruzzese, Piscataway, NJ (US); Brian S. Welborn, The Woodlands, TX (US)

(73) Assignee: Thomas & Betts International, Inc., Sparks, NV (US)

Reexamination Request:
No. 90/009,705, Apr. 19, 2010

Reexamination Certificate for:

| | |
|---|---|
| Patent No.: | **7,192,308** |
| Issued: | **Mar. 20, 2007** |
| Appl. No.: | **10/848,497** |
| Filed: | **May 18, 2004** |

( * ) Notice: This patent is subject to a terminal disclaimer.

Certificate of Correction issued May 29, 2007.

Related U.S. Application Data

(63) Continuation of application No. 10/359,498, filed on Feb. 6, 2003, now Pat. No. 6,767,247, which is a continuation of application No. 09/852,343, filed on May 9, 2001, now Pat. No. 6,530,807.

(60) Provisional application No. 60/215,299, filed on Jun. 30, 2000, and provisional application No. 60/202,972, filed on May 10, 2000.

(51) Int. Cl.

| | |
|---|---|
| ***A61K 9/20*** | (2006.01) |
| ***A61K 9/00*** | (2006.01) |
| ***H01R 13/506*** | (2006.01) |
| ***H01R 13/52*** | (2006.01) |
| ***H01R 9/05*** | (2006.01) |

(52) U.S. Cl. ..... 439/578; 439/584; 439/585

(58) Field of Classification Search ..... None
See application file for complete search history.

(56) References Cited

To view the complete listing of prior art documents cited during the proceeding for Reexamination Control Number 90/009,705, please refer to the USPTO's public Patent Application Information Retrieval (PAIR) system under the Display References tab.

*Primary Examiner*—Margaret Rubin

(57) ABSTRACT

A connector is provided for terminating coaxial cable. The connector includes a connector body having a cable receiving end and an opposed connection end. A locking sleeve is provided in detachable, re-attachable snap engagement with the insertion end of the connector body for securing the cable in the connector body. The cable may be terminated to the connector by inserting the cable into the locking sleeve or the locking sleeve may be detachably removed from the connector body and the cable inserted directly into the cable body with the locking sleeve detached subsequently.

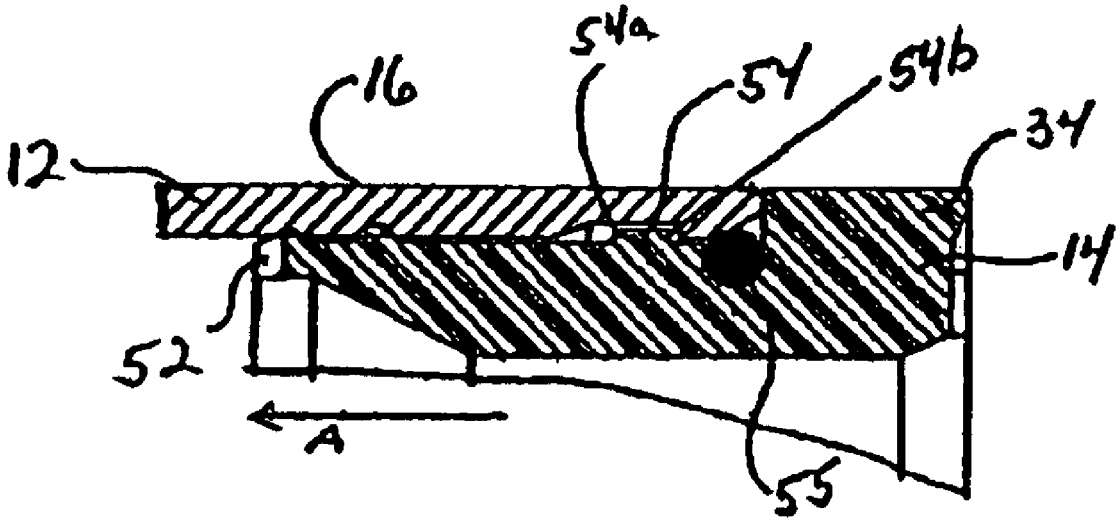

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 6, 11, 13, 15 and 18 are determined to be patentable as amended.

Claims 2-5, 7-10, 12, 14, 16 and 17 dependent on an amended claim, are determined to be patentable.

1. A connector for terminating an end of a coaxial cable comprising:

a connector body having a cable receiving end for accommodating said end of said cable; and a locking sleeve coupled to said cable receiving end of said body and being detachable and reattachable thereto to define an attached position and a detached position, said locking sleeve adapted to receive said cable end in either of said attached or detached positions and being movable with respect to said connector body for *inseparably* locking said cable to said connector body;

wherein said connector body and said locking sleeve include cooperative detent structure for permitting said detachment and reattachment of said connector body and said locking sleeve, said cooperative detent structure including:

said connector body having a rib; and said locking sleeve including an annular groove defined between a pair of spaced apart sleeve rings;

said rib being resident within said groove in a first position, *said rib in a second position to engage a portion of the locking sleeve to provide the inseparable locking of said cable to said connector body*; and wherein said sleeve rings include a forward sleeve ring and a rearward sleeve ring, said forward sleeve ring including a rearwardly directed chamfered wall to permit resilient detachment of said locking sleeve from said body.

6. A connector of claim 1 wherein said locking sleeve is movable with respect to said body from [a] *the* first position retaining said cable end to [a] *the* second position *inseparably* locking said cable to said cable body.

11. A coaxial cable connector comprising:

a connector body having a receiving end; and a locking sleeve formed of resilient plastic and attachably coupled to said connector body receiving end, said locking sleeve having a rearward end through which an end of a prepared coaxial cable may be inserted and a forward end defining a forward peripheral edge opposite said rearward end, *the forward peripheral edge being at the very edge of the forward end,* said forward end being insertable into said receiving end of said connector body and having a radially outwardly directed ring formed at said forward *peripheral edge* end, said ring cooperating with structure at said connector body receiving end for holding said locking sleeve in said connector body in a first position;

wherein said locking sleeve is detachable *in the first position* and reattachable to said cable receiving end of said body, said detachable and reattachable attachment being facilitated by said resiliency of said plastic material; and wherein said locking sleeve is movable with respect to said connector body to a second position for locking said cable within said connector.

13. A coaxial cable connector comprising:

a connector body having a receiving end and an annular rib; and a locking sleeve formed of resilient plastic and attachably coupled to said [connetor] *connector* body receiving end, said locking sleeve having a rearward end through which an end of a prepared coaxial cable may be inserted and a forward end defining a forward peripheral edge opposite said rearward end, said forward end being insertable into said receiving end of said connector body and having an annular groove defined between first and second spaced apart rings formed at said forward end, said rings cooperating with said [annualar] *annular* rib of said connector body receiving end for holding said locking sleeve in said connector body in a first position, *one of said rings being disposed at the forward peripheral edge of the forward ring*;

wherein said locking sleeve is detachable *in the first position* and reattachable to said cable receiving end of said body, said detachable and reattachable attachment being facilitated by said resiliency of said plastic material; and wherein said ring formed on said forward peripheral edge of said locking sleeve includes a rearwardly directed chamfered wall to permit detachment of said locking sleeve from said body.

15. A coaxial cable connector for terminating an end of a coaxial cable comprising:

a connector body having a cable receiving end; and a locking sleeve removably secured to said cable receiving end of said connector body and movable from a first position retaining said cable end to a second position *inseparably* locking said cable to said connector body;

said locking sleeve being optionally attached to or detached from said body prior to inserting said coaxial cable into said cable receiving end for subsequent cable termination within said body;

wherein one of said connector body or said locking sleeve having a rib and the other of said connector body or locking sleeve including a mating groove *defined between a pair of radially outwardly extending sleeve rings*, said rib being resident within said groove in said first position for permitting said locking sleeve to be removably secured to said connector body, *said rib engages and rides over a portion of the other of said connector body or locking sleeve to the second position in which said cable is inseparably locked to said connector body*.

18. A cable connector comprising:

a connector body having a retention rib with a first wall and a chamfered second wall axially opposite the first wall;

a locking sleeve having an attachment end that is secured to the connector body and a cable receiving end opposite the attachment end, the locking sleeve including a *detachable and reattachable* shipping position and [a] *an inseparably* locked position*, wherein the retention rib engages the locking sleeve in the inseparably locked position*;

a first annular flange disposed on the attachment end; and a chamfered second annular flange disposed on the attachment end and axially spaced from the first annular flange such that a groove is formed between the first annular flange and the second annular flange for receiving the retention rib therein and that the chamfer of the second annular flange is complementary to the chamfer of the second wall for transitioning the locking sleeve from the shipping position to the locked position.

* * * * *